United States Patent [19]

McKenzie

[11] Patent Number: 4,944,239

[45] Date of Patent: Jul. 31, 1990

[54] FLAP RUDDER AND STEERING SYSTEM

[76] Inventor: John S. McKenzie, 4039 Violet Street, North Vancouver, British Columbia, Canada

[21] Appl. No.: 250,680

[22] PCT Filed: Jan. 15, 1987

[86] PCT No.: PCT/GB87/00022

§ 371 Date: Nov. 15, 1988

§ 102(e) Date: Nov. 15, 1988

[87] PCT Pub. No.: WO88/05395

PCT Pub. Date: Jul. 28, 1988

[51] Int. Cl.[5] ..... B63H 25/06

[52] U.S. Cl. ..... 114/162; 114/246; 114/253

[58] Field of Search ..... 114/162, 253, 254, 246, 114/165, 167, 168

[56] References Cited

U.S. PATENT DOCUMENTS

| | | | |
|---|---|---|---|
| 2,813,689 | 11/1957 | Norton et al. | 114/167 |
| 3,469,552 | 9/1969 | Patrick | 114/253 |
| 4,275,677 | 6/1981 | Nelson | 114/253 |
| 4,307,677 | 12/1981 | Jastram et al. | 114/167 |
| 4,463,700 | 8/1984 | Becker | 114/162 |
| 4,510,880 | 4/1985 | Kuribayashi | 114/162 |

*Primary Examiner*—Sherman D. Basinger
*Assistant Examiner*—Stephen P. Avila
*Attorney, Agent, or Firm*—Armstrong, Nikaido, Marmelstein, Kubovcik & Murray

[57] ABSTRACT

An automatic steering control system between a towing marine vehicle and a towed marine vehicle comprising a main rudder and an active flap rudder extension on the towed vehicle controlled for independent oscillation by an active flap actuator that imparts a turning force to the flap in one direction to cause the flap and rudder to move together in an opposite direction and control means extending between the towing and towed vehicles for automatically controlling the active flap rudder extension.

13 Claims, 4 Drawing Sheets

FLAP RUDDER AND STEERING SYSTEM

This invention relates to a rudder control apparatus for marine vessels, and to a control system for that apparatus.

SUMMARY OF THE INVENTION

The rudder control apparatus of one aspect of the invention is mounted on a barge or other vessel being towed, and effects steering through a main rudder extension in the form of a wedge-shape flap. This flap, hereinafter referred to as the active flap, articulates about a vertical axis which is separate from the main rudder axis and rearwardly spaced from it.

In the preferred embodiment, the control system for the active flap is mounted on the vessel being towed, and includes two main control links.

The first control link is a tow line direction sensor that generates an electric signal to pneumatic or hydraulic control valves in an active flap actuator. This permits the flow of a pressurized medium into one side or the other of the active flap actuator, and provides a controlled oscillation of the active flap itself.

The second control link is a radio telemetry link between the vessel being towed and another vessel which is towing it. This enables the towing vessel to assume complete and remote control of the active flap steering system on the towed vessel. A rudder angle sensor permits different degrees of rudder angle to be applied.

In operation, a movement of the active flap to port causes the main rudder to move to starboard, carrying the active flap, and this in turn moves the towed vessel to starboard. A turning force on the flap in one direction moves the main rudder in the opposite direction.

In one embodiment, the towed vessel is provided with twin rudders which are fitted with failsafe devices such that, upon control system failure, the active flaps move the twin rudders in opposing directions so as to increase drag at the stern of the towed vessel. This renders the use of the conventional skegs unnecessary.

More particularly, this invention provides an active flap steering system comprising a main rudder and an active flap rudder extension controlled for independent oscillation by an active flap actuator that imparts a turning force to the flap in one direction to cause the flap and the rudder to move together in an opposite direction. The active flap actuator forms part of an automatic control system between a towing vessel and a towed vessel.

BRIEF DESCRIPTION OF THE DRAWINGS

Two embodiments of this invention are illustrated in the accompanying drawings, in which like numerals denote like parts throughout the several views, and in which.

DESCRIPTION OF THE PREFERRED EMBODIMENTS

Figure 1:
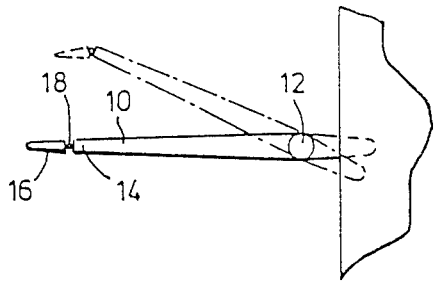
FIG. 1 is a plan view of the aft end of a barge or other towed vessel.

Referring first to FIG. 1, a main rudder 10 is rotatably mounted about a rudder stock axis 12. At the trailing end 14 of the rudder 10 is a hinged portion that constitutes the active flap 16. A flap actuator 18 directly and mechanically controls the angle of the active flap 16 with respect to the rudder 10. The movement of the active flap 16 is independent of the main rudder 10, but in turn controls the main rudder for movement in an opposing direction. The main rudder 10 is mounted for free rotation about the axis 12. FIG. 1 shows in solid lines the positions of the rudder 10 and the active flap 16 when they are aligned with each other and the main axis of the towed vessel. FIG. 1 also shows in broken lines a possible angulated position, in which the rudder 10 has moved in the clockwise direction, while the active flap 16 has moved in a counterclock wise direction with respect to the rudder 10.

Figure 2:
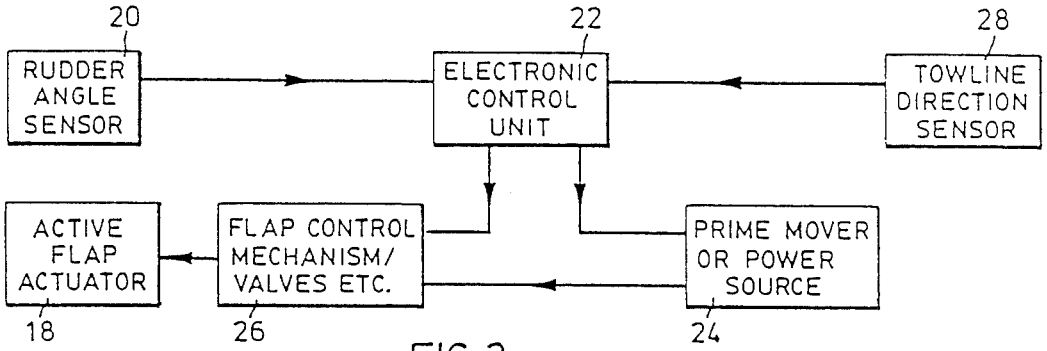
FIG. 2 is a schematic layout of the control system.

A control system, shown in greater detail in FIG. 2, governs the active flap actuator 18, and thus controls movement of the active flap 16 to port or starboard.

The flap actuator 18 may advantageously comprise hydraulic or pneumatic cylinders having suitable control valves, in order to cause rotation of the active flap 16 with respect to the rudder 10. An electronic control unit would be provided for the purpose of controlling the valves. Alternatively, the drive mechanism of the flap actuator 18 may include a rotary vane cylinder, single or multiple rams, a gear drive, chain drive or any other suitable mechanical equivalent.

A control system layout is illustrated in FIG. 2, which incorporates a rudder angle sensor 20, the electronic control unit 22 mentioned above, a prime mover or power source 24, the flap control mechanism (valves, etc.) 26 and the active flap actuator 18. The scheme of FIG. 2 also shows input into the electronic control unit 22 from a tow line direction sensor 28.

Figure 3:
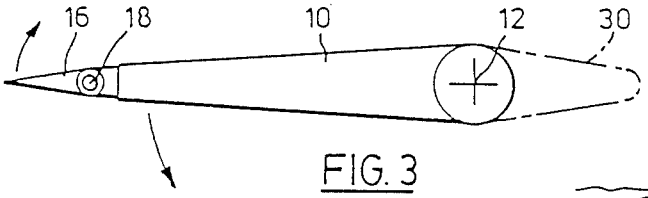
FIG. 3 is a plan view of the active flap and main rudder assembly.

FIG. 3 shows, to a larger scale, the rudder 10 hinged about the rudder stock axis 12, with an optional forward portion of the rudder being shown in broken line at 30. Also seen in FIG. 3 is the active flap 16 and the actuator 18.

To ensure that a barge or other towed vessel fitted with the system of the present invention will automatically and accurately follow the tow boat or other vessel pulling it, some means of continuously monitoring the relative positions of the two vessels is necessary. In the following discussion, the terms barge and tow boat will be utilized, these being convenient labels for the two vessels.

Figure 4:
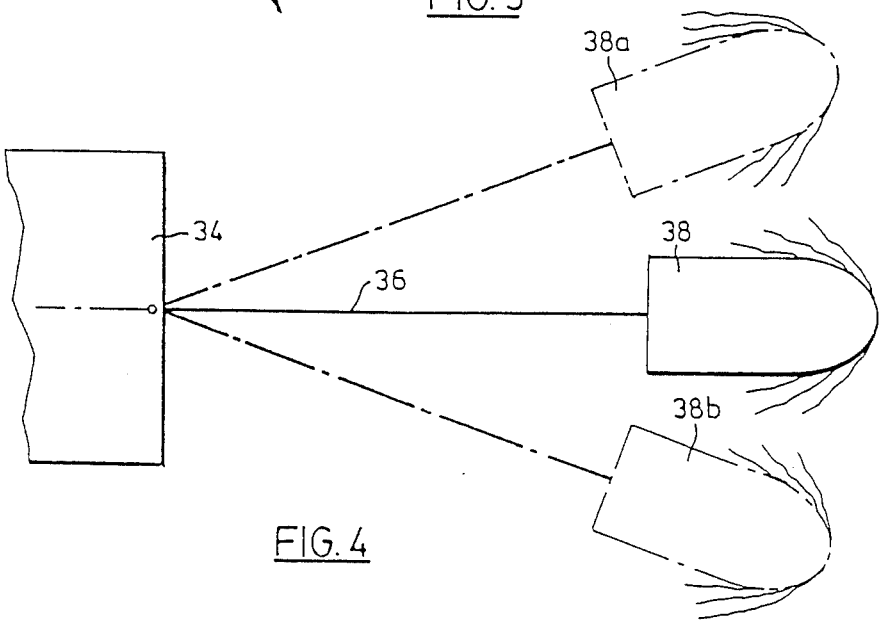
FIG. 4 is a plan view of a tug towing a barge or the like showing single point towing arrangements and variations of tow line angles.

The continuous monitoring mentioned in the previous paragraph is accomplished by monitoring the angle that the tow line makes with the fore and aft centre line of the barge. The angle varies from the port to starboard side of the centre line, depending upon the position of the tow boat. In FIG. 4, the barge is shown at 34, with a tow line 36 connecting the barge to a tow boat 38. Seen in broken lines to the left and right of the solid line position of the tow boat 38 are two further possible positions of the tow boat marked 38*a* and 38*b*. The aim of the continuous monitoring system is to bring the barge back into alignment with the tow line direction and this is done by a tow line angle sensor on the barge which senses movement of the tow line and will be described below.

In both embodiments of the tow line angle sensor to be described now, the sensor has an arm or equivalent member which moves in the same direction as the tow line, the angular movement thereof being sensed and relayed to a computer based control unit by one of the following means:

(a) variable resistance potentiometers (linear or rotational),
(b) hydraulic cylinders, actuators or valves with appropriate pipework,
(c) mechanical linkage means,
(d) strain gauges or electronic load cells.

Figure 5:
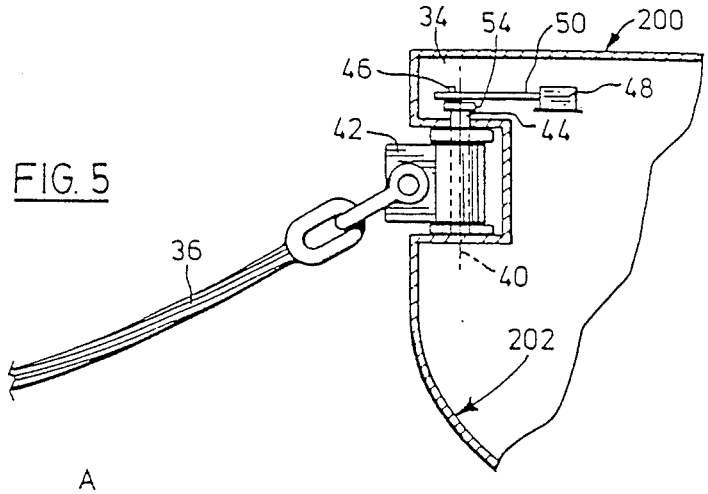
FIG. 5 is a partially sectioned side elevation of the forward end of a barge or other towed vessel, showing the connection to a tow line.
Figure 6:
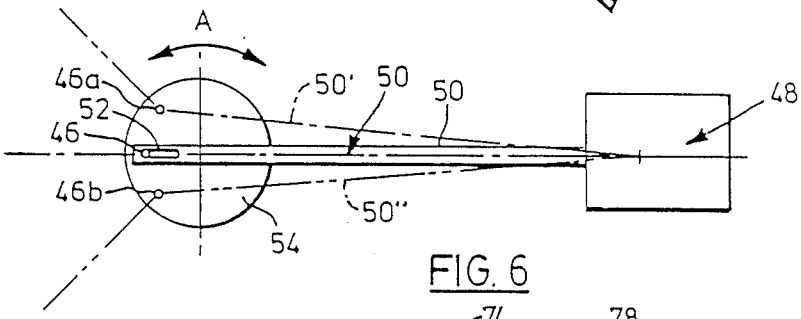
FIG. 6 is a somewhat schematic plan view showing the tow line angle sensor and its connections.

Attention is now directed to FIGS. 5 and 6, for a description of the first embodiment of the sensor. In FIG. 5, the front end or prow of the barge 34 is shown. Pivotally mounted about a vertical axis 40 on the barge 34 is a swivel member 42 to which a tow line 36 is connected in the manner shown in FIG. 5. It will be appreciated that, as the tow line 36 moves to the port or starboard side of the centre line of the barge, the swivel member 42 will swing to keep itself in alignment with the tow line 36. The barge has a deck 200, and is provided with shell plating 202.

Swinging movement of the swivel member 42 causes movement of an upstanding shaft 44 which supports an eccentric pin 46 also projecting upwardly.

A tow line angle sensor 48 is mounted within the barge adjacent the swivel member 42, and has a sensor arm 50 which, as seen in FIG. 6, has an elongate slot 52 which receives the pin 46. The pin is secured to a disc 54 which can be seen in both FIGS. 5 and 6. It will be seen that, as the swivel member 42 swings from side to side, the same motion will be undergone by the disc 54, as shown at arrow A, thus carrying the pin 46 between the positions shown in FIG. 6 as 46*a*, 46 and 46*b*. This arcuate movement of the pin 46, all the time remaining in the slot 52, will cause swinging movement of the sensor 50, as indicated in FIG. 6 by the broken centre lines 50' and 50''.

Alternatively, the rotational position of the upstanding shaft 44 can be sensed by a rotational potentiometer (not shown), mounted on the vertical centre line of the shaft 44.

At the rudder control unit 22 (FIG. 2), the tow line angle information proceeding from the tow angle sensor 48 is converted into an electrical signal (if not already in that form) and utilized to control operation of the active flap actuator 18.

Figure 7:
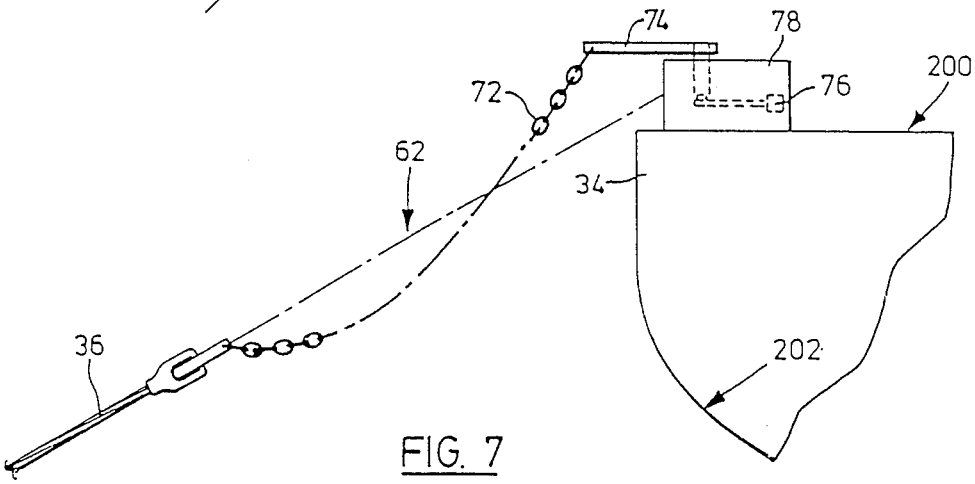
FIG. 7 is a partial side elevation of the forward end of a barge or other towed vessel, showing a further embodiment of the tow line angle sensor.
Figure 8:
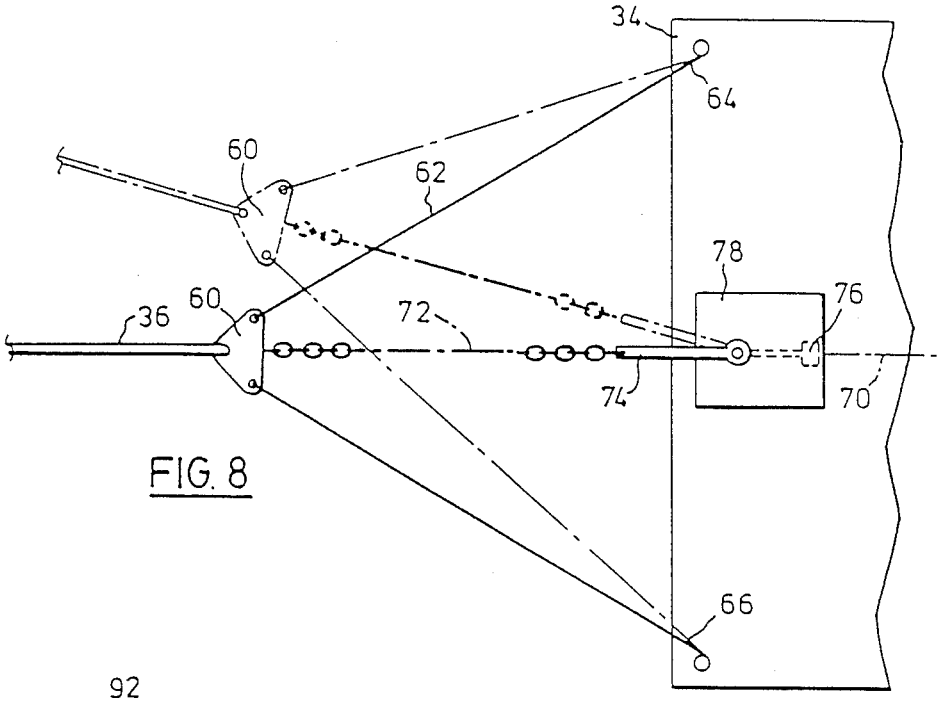
FIG. 8 is a plan view of the apparatus shown in FIG. 7.

An alternative means of sensing the tow line direction is shown in FIGS. 7 and 8. The forward or prow end of the barge 34 is provided with a towing bridle attachment comprising a flounder plate 60 and a bridle 62, the bridle 62 having its two ends 64 and 66 connected to the barge at spaced apart locations as seen in FIG. 8. Preferably, these locations are symmetrically disposed on either side of the barge centre line 70. The bridle 62 is attached to the flounder plate 60, so that the flounder plate can move from side to side as seen by comparing the solid line and broken line positions of the flounder plate seen in FIG. 8. The tow line 36 is attached to the flounder plate 60, and a somewhat slack chain 72 (or other flexible elongate member) is connected at one end to the flounder plate 60 and at the other end to a sensor arm 74 forming part of a tow line angle sensor 76. A mounting housing 78 supports and protects the sensor 76 and also supports the arm 74 for swivelling movement as best seen in FIG. 8. It will be seen that, as the tow line 36 swings from side to side with respect to the centre line 70 of the barge 34, the flounder plate 60 will move from side to side, carrying the chain 72 along with it. The latter movement will cause movement of the tow line sensor arm 74, which movement can be detected by the sensor 76 utilizing either a rotational potentiometer as described above, or an eccentric mechanism substantially the same as that already described with respect to FIGS. 5 and 6.

The control unit thus continuously monitors and processes the tow line angle and its rate of angular change to the centre line of the barge in order to determine when and in which direction the rudder (or rudders) should be turned. Turning of the rudder is achieved by moving the active flap in the opposite direction to the desired direction of rotation on the main rudder.

Figure 9:
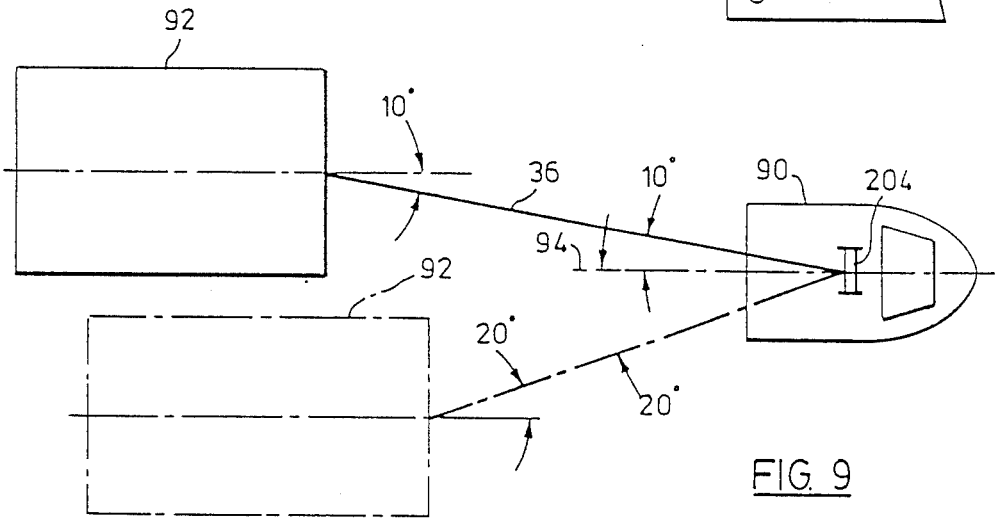
FIG. 9 is a plan view of a towing vessel pulling a towed vessel in two possible positions.

In addition to the barge tracking directly behind the tow boat, the computer control unit can also allow the barge to be towed at an offset, to the port or starboard side of the tow boat. The offset can be controlled locally or by radio telemetry. This is illustrated in FIG. 9, in which a tow boat 90 tows a barge 92 which is shown in solid lines displaced to the port side of the tow boat centre line 94, and in broken lines to the starboard side. The tow line is seen at 36. The solid position is approximately 10° to port, whereas the broken line position is approximately 20° to starboard. Reference numeral 204 indicates the towing point.

In order to provide this control, commands are sent from the tow boat 90 to the barge directly via a radio system. Information regarding the response of the barge and the rudder to the radio commands from the tow boat are continuously relayed back to the tow boat for the benefit of the tow boat captain.

In this mode of operation, the radio control system overrides the automatic tow line tracking system. An arrangement could be provided, however, such that if radio controls are not operated or no signal is sent for a specific period of time, the barge steering system will revert back to the automatic tow line tracking mode of operation described earlier.

A further alternative for automatic tow line tracking involves providing a gyro compass on both the tow boat and the barge. The barge's computer based control unit would compare the tow boat gyro compass course (sent by radio telemetry to the barge control unit) with the gyro course of the barge itself. The difference between the gyro compasses would provide information equivalent to that which is provided by the two line angle sensors described earlier, and would permit an alternative method of tracking.

Figure 10:
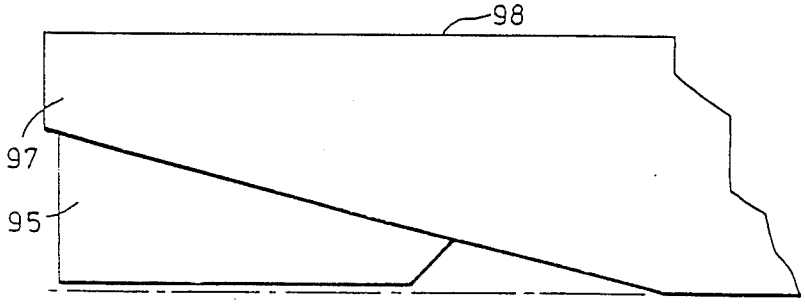
FIG. 10 PRIOR ART
FIG. 10 is a side elevation of a conventional barge construction, showing a typical skeg.
Figure 11:
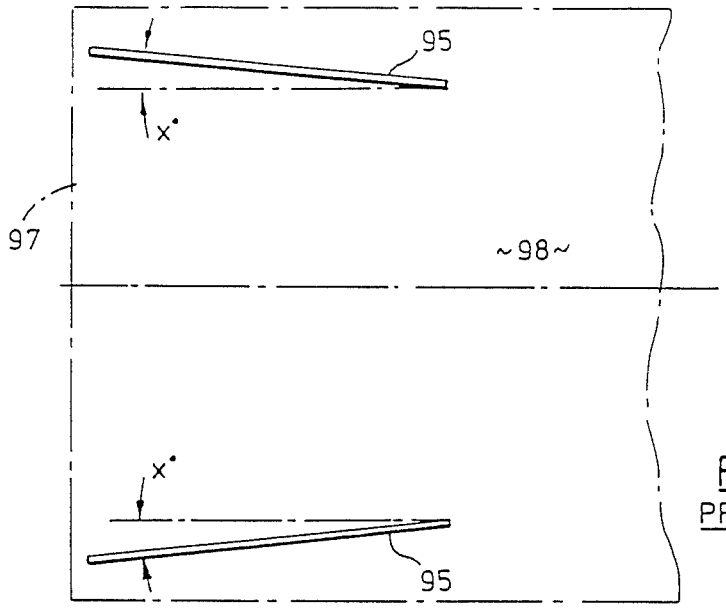
FIG. 11 PRIOR ART
FIG. 11 is a plan view of a conventional barge, showing the configuration of two angulated skegs at the aft end.

Attention is now directed to FIGS. 10 and 11, which represent the prior art. These figures show the typical position and orientation of skegs 95, which are typically fitted at the aft end 97 of a barge 98 in order to provide a predetermined amount of drag, typically between 20% and 40% of the total resistance. This is done to ensure that the barge, under ideal conditions, will tend to follow a straight line behind the tow boat. In FIG. 11, the angle x represents the obliquity of each skeg with respect to the fore-aft centre line of the barge.

As will be understood, the conventional provision of angulated skegs represents a disadvantage in the sense that it increases the total drag of the barge by a substantial amount, thus increasing the amount of energy that needs to be expended to tow the barge. An aspect of the present invention is to avoid this additional drag on a barge or other towed vessel arising from the use of skegs, by providing a failsafe system incorporating twin rudders, such that if control power fails, the twin rudders will automatically be moved to opposite angulated positions in order to produce a drag similar to that arising from the conventional skegs.

Figure 12:
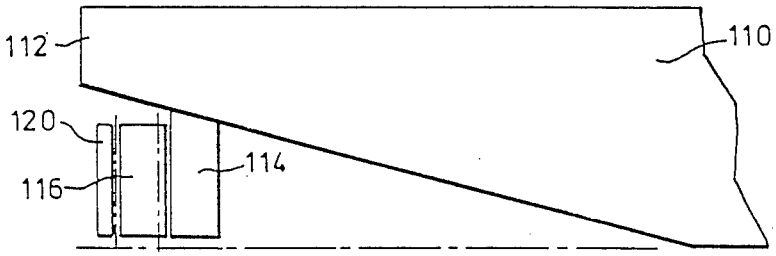
FIG. 12 is a side elevation of a barge fitted with a particular embodiment of the steering system of this invention.
Figure 13:
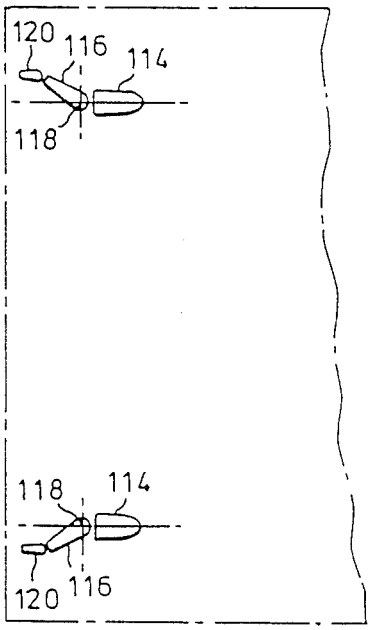
FIG. 13 is a plan view of the barge shown in FIG. 12.

Attention is directed to FIGS. 12 and 13, which show a barge 110 having at the stern end 112 two downwardly extending stern frames 114. Each stern frame 114 supports a main rudder 116 freely rotatable about a substantially vertical axis 118.

Figure 14:
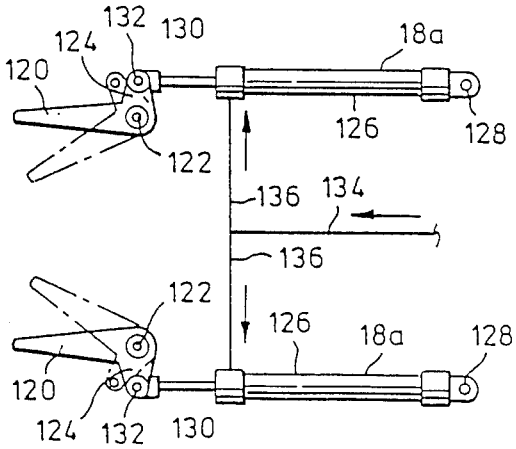
FIG. 14 is a schematic view showing a failsafe mechanism for controlling the active flaps on a two-rudder system.

The free end of each rudder 116 supports an active flap 120 for controlled arcuate movement with respect to the rudder 116. FIG. 13 shows the failsafe position of the active flaps 120, i.e. the positions which they assume when control power fails. FIG. 14 shows schematically how a typical failsafe arrangement would work. The figure shows the two active flaps 120, each pivoted about a substantially vertical pivot axis 122, and each having a laterally extending arm portion 124. The arrangement includes two flap actuators 18*a*, each consisting of a cylinder 126 having one end pivoted at 128 to a location fixed on the respective main rudder 116. A piston rod 130 is pivotally connected at one end 132 to a location on the respective arm 124 of the active flap 120, and is connected at its other end to a piston (not seen in the figure) which rides within the cylinder 126. A coil compression spring within each cylinder 126 continuously urges the piston and the piston rod leftwardly as pictured in FIG. 14, i.e. in a direction which will cause the active flaps 120 to assume the broken-line positions in FIG. 14. Adjustment of the active flap orientation is brought about by controlling the hydraulic pressure in a line 134 which branches into two lines 136, the two lines 136 being in communication with the cylinders 126 on the side of the piston opposite the compression spring. Thus, as hydraulic pressure in the line 134 increases, the pistons and the piston rods 130 are moved rightwardly, which causes the active flaps 120 to swivel from the broken-line position toward the solid-line position in FIG. 14. Upon failure of hydraulic pressure in the line 134, the compression coil springs inside the cylinders 126 cause the active flaps automatically to assume the brokenline (fail safe) position as seen in FIG. 14, which will bring the main rudders 116 into the positions shown in FIG. 13. This will cause the rudders 116 to act in a manner similar to the skegs 95 seen in FIG. 10 and FIG. 11, producing a drag at the aft end of the towed vessel which will tend to keep the towed vessel tracking in a straight line behind the towing vessel.

Figure 15:
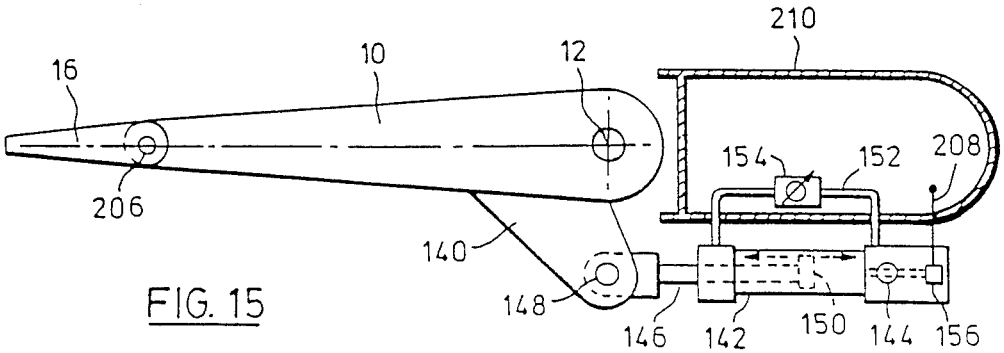
FIG. 15 is a schematic view of a combined shock absorber and rudder angle indicator for use with this invention.

Attention is now directed to FIG. 15, which shows schematically an arrangement for providing a combined shock absorber and rudder angle indicator. In FIG. 15, a main rudder 10 is illustrated, having an active flap 16 pivoted about the aft end thereof at 206. The main rudder 10 swings about an axis 12, and has a laterally projecting bracket 140. A cylinder 142 is pivotally connected to the vessel at a pivot point 144, and a rod member 146 is pivotally connected at one end 148 to the bracket 140. The other end of the rod member 146 is connected to a piston 150 slidable in the cylinder 142. The cylinder 142 defines two closed chambers, one on either side of the piston 150, and a conduit 152 interconnects the two chambers. A flow control valve 154, which may be variable, provides resistance to fluid flow through the conduit 152, thus providing a shock absorbing function for the main rudder 10. The block 156 designates a means for sensing the linear position of the piston 150 within the cylinder 142, and this information can then be sent, e.g. by electrical relay 208 to a control unit for the respective active flap. Reference numeral 210 designates the stern frame.

While one embodiment of this invention has been illustrated in the accompanying drawings and described hereinabove, it will be evident to those skilled in the art that changes and modifications may be made therein without departing from the essence of this invention, as set forth in the appended claims.

I claim:

1. An active flap steering system for a towed vessel (34) having a rudder (10) mounted for swivelling movement about a rudder axis (12), characterized in that there is provided an active flap rudder extension (16) controlled for independent oscillation by an active flap actuator (18) that imparts a turning force to swing the flap rudder extension (16) with respect to the rudder (10) in a first direction, causing the extension (16) and the rudder (10) to swing together in a direction opposite to said first direction, said active flap actuator (18) forming part of an automatic control system between a towing vessel (38, 90) and the towed vessel (34, 92), said control system including means mounted on said towed vehicle and responsive to deviations of said towed vehicle from a preset towed path, for activating said automatic control system for actuating said active flap actuator and adjusting said active flap rudder extension for resetting said towed vehicle to said preset path.

2. The system claimed in claim 1, in which the control system includes a radio telemetry link between the towing vessel (38,90) and the towed vessel (34,92).

3. The system claimed in claim 1 or 2, in which the control system governs movement of the flap rudder extension (16) in response to the angle of a tow rope (36) with respect to the towed vessel (34,92).

4. The system claimed in claim 1 or 2, in which the control system governs movement of the flap rudder extension (16) in response to a preselected angle between the tow rope (36) and the towing vessel (38,90).

5. The system claimed in claim 1, in which the towed vessel (110) has two rudders (116) mounted for swivelling movement about two rudder axes at the stern (112) of the vessel (110), the axes being spaced apart laterally of the vessel (110), each rudder (116) having an active flap rudder extension (120) controlled for independent oscillation by an active flap actuator, both active flap rudder extensions (120) being biased toward positions in which they cause their respective rudders (116) to be oppositely angulated with respect to the fore-aft centre line of the vessel (110), thereby to exert a drag on the vessel (110) when the active flap rudder extensions (120) are in said positions.

6. The system claimed in claim 1, further including a combined shock absorber and angle indicator for the rudder (10), comprising:

a bracket (140) secured to the rudder (10), a cylinder (142) pivotally connected to the vessel (34,92), a rod member (146) pivotally connected at one end (148) to the bracket (140) and having at the other end a piston (150) slidable in the cylinder (142), the cylinder (142) defining two closed chambers, one on either side of the piston (150), a conduit means (152) interconnecting the two chambers, a flow control valve (154) in said conduit, and means (156) for sensing the linear position of the piston (150) in the cylinder (142).

7. A vessel (34, 92) adapted to be towed by a towing means (38, 90), said vessel (34, 92) comprising a main rudder (10) at the rear of the vessel (34, 92), the main rudder (10) being mounted for swinging movement about a rudder pivot axis (12) and projecting generally rearward therefrom, characterized in that there is provided an active flap rudder extension (16) pivotally mounted to the rudder (10) remote from the rudder pivot axis (12) and projecting generally rearward with the rudder (10), an active flap actuator (18) for positively swinging the flap rudder extension (16) with respect to the rudder (10) so that when the flap rudder extension (16) swings in one direction it causes the rudder (10) to swing in the opposite direction, and an active flap steering system adapted to control the actuator (18) in response to an input, said active flap steering system including means mounted on said vessel and responsive to deviations of said vessel from a preset towed path for actuating said active flap steering system and adjusting said flap rudder extension for resetting said towed vehicle to said preset path.

8. The vessel claimed in claim 7, in which said input is the angle between the vessel (34,92) and a tow line (36) pulling the vessel (34,92).

9. The vessel claimed in claim 8, in which said active flap steering system includes a swivel member (42) at the bow of said vessel (34, 92) to which the tow line (36) is connected, the swivel member (42) having an eccentric means (46) which swings with the swivel member (42) and a tow line angle sensor (48) having an arm (50) operatively connected to said eccentric means (46), whereby to detect departures of the tow line direction from a desired direction with respect to the vessel (34, 92).

10. The vessel claimed in claim 8, in which said active flap steering system includes a swivel member (42) at the bow of said vessel to which the tow line (36) is connected, and a rotational potentiometer operatively connected to said swivel member (42) for detecting the rotational position of said swivel member (42).

11. The vessel claimed in claim 8 in which said active flap steering system includes a towing bridle attachment at the bow of said vessel (34, 92) comprising a flounder plate (60) and a bridle (62) having two ends connected to the vessel (34) at spaced apart locations, the bridle (62) being attached to the flounder plate (60), the flounder plate (60) having means for the attachment of the tow line (36) thereto, and a slack, flexible, elongated member (72) connected at one end to the flounder plate (60), the vessel (34, 92) having further a tow line angle sensor (76) mounted between said spaced apart locations, the sensor (76) having a sensor arm (74), the other end of said elongated member (72) being attached to said sensor arm (74).

12. The vessel claimed in claim 7, which has two rudders (116) mounted for swivelling movement about two rudder axes at the stern (112) of the vessel (110), the axes being spaced apart laterally of the vessel (110), each rudder (116) having an active flap rudder extension (120) controlled for independent oscillation by an active flap actuator, both active flap rudder extensions (120) being biased toward positions in which they cause their respective rudders (116) to be oppositely angulated with respect to the fore-aft centre line of the vessel (110), thereby to exert a drag on the vessel (110) when the active flap rudder extensions (120) are in said positions.

13. The vessel claimed in claim 7, further including a combined shock absorber and angle indicator for the rudder (10), comprising:

a bracket (140) secured to the rudder (10), a cylinder (142) pivotally connected to the vessel (34,92), a rod member (146) pivotally connected at one end (148) to the bracket (140) and having at the other end a piston (150) slidable in the cylinder (142), the cylinder (142) defining two closed chambers, one on either side of the piston (150), a conduit means (152) interconnecting the two chambers, a flow control valve (154) in said conduit, and means (156) for sensing the linear position of the piston (150) in the cylinder (142).

* * * * *